US008311462B2

(12) United States Patent
Okamura

(10) Patent No.: US 8,311,462 B2
(45) Date of Patent: Nov. 13, 2012

(54) DEVELOPER SUPPLY DEVICE

(75) Inventor: Mitsukiyo Okamura, Aichi (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 276 days.

(21) Appl. No.: 12/726,047

(22) Filed: Mar. 17, 2010

(65) Prior Publication Data

US 2011/0064483 A1 Mar. 17, 2011

(30) Foreign Application Priority Data

Sep. 16, 2009 (JP) ..... 2009-214054

(51) Int. Cl.
*G03G 15/08* (2006.01)

(52) U.S. Cl. ..... 399/265

(58) Field of Classification Search ..... 399/107, 399/119, 120, 222, 252, 265, 266
See application file for complete search history.

(56) References Cited

U.S. PATENT DOCUMENTS

| | | | | |
|---|---|---|---|---|
| 5,142,336 | A | 8/1992 | Hotomi et al. | |
| 6,697,592 | B2 * | 2/2004 | Adachi et al. | 399/265 |
| 2009/0080941 | A1 | 3/2009 | Nishiwaki et al. | |
| 2009/0175662 | A1 | 7/2009 | Nishiwaki | |
| 2009/0297228 | A1 | 12/2009 | Maeda et al. | |

FOREIGN PATENT DOCUMENTS

| | | | |
|---|---|---|---|
| JP | HEI 3-12678 | | 1/1991 |
| JP | HEI 06-161236 | | 6/1994 |
| JP | 2002-284795 | | 10/2002 |
| JP | 2005-31385 | | 2/2005 |
| JP | 2006-47654 | A | 2/2006 |
| JP | 2008-70803 | A | 3/2008 |
| JP | 2009-3212 | | 1/2009 |
| JP | 2009-080267 | | 4/2009 |
| WO | WO 2008/066015 | A1 | 6/2008 |

OTHER PUBLICATIONS

Notification of Reasons for Rejection dated Jul. 26, 2011 received from the Japanese Patent Office from related Japanese Application No. 2009-214054, together with an English-language translation.

* cited by examiner

*Primary Examiner* — Hoan Tran
(74) *Attorney, Agent, or Firm* — Scully, Scott, Murphy & Presser, PC

(57) ABSTRACT

A developer supply device, including a developer holding body having a cylindrical developer holding surface so that the developer holding surface moves in a direction perpendicular to the main scanning direction and a developer held on the developer holding surface is carried to a developer supply position; a developer amount limiting member that limits an amount of the developer held on the developer holding surface by contacting the developer holding surface on an upstream side in a moving direction of the developer holding surface with respect to the developer supply position; and a carrying substrate that carries the developer to the developer holding body through a traveling electric field, wherein the carrying substrate faces the developer holding surface at a developer holding position, and wherein a position to which the developer scraped off the developer holding surface falls is different from the developer holding position.

6 Claims, 6 Drawing Sheets z

DEVELOPER SUPPLY DEVICE

CROSS-REFERENCE TO RELATED APPLICATION

This application claims priority under 35 U.S.C. §119 from Japanese Patent Application No. 2009-214054, filed on Sep. 16, 2009. The entire subject matter of the application is incorporated herein by reference.

BACKGROUND

1. Technical Field

Aspects of the present invention relate to a developer supply device configured to supply a developer to a supply target.

2. Related Art

Developer supply devices having a developer carrying unit and a developer holding body have been widely used. In such a developer supply device, the developer holding body is located to face a photosensitive drum and to hold the charged developer on a circumferential surface thereof. The developer carrying unit carries the developer from a reservoir to the developer holding body through a traveling electric field. The developer carried to the developer holding body is then supplied to the photosensitive drum by rotation of the developer holding body.

SUMMARY

However, if the developer is not properly held on the developer holding body, the quality of a formed image may deteriorate.

Aspects of the present invention are advantageous in that a developer supply device configured such that a developer can be appropriately held on a developer holding body is provided.

According to an aspect of the invention, there is provided a developer supply device, comprising: a developer holding body having a cylindrical developer holding surface and a rotation axis extending in a main scanning direction so that, by rotating about the rotation axis, the developer holding surface moves in a direction perpendicular to the main scanning direction and a developer held on the developer holding surface is carried to a developer supply position where the developer holding surface faces a supply target; a developer amount limiting member that limits an amount of the developer held on the developer holding surface by contacting the developer holding surface on an upstream side in a moving direction of the developer holding surface with respect to the developer supply position; and a carrying substrate that carries the developer from a developer reservoir to the developer holding body through a traveling electric field, wherein the carrying substrate faces the developer holding surface at a developer holding position where the developer is held on the developer holding surface, and wherein a position to which the developer scraped off the developer holding surface by the developer amount limiting member falls is different from the developer holding position.

BRIEF DESCRIPTION OF THE ACCOMPANYING DRAWINGS

DETAILED DESCRIPTION

Hereafter, an embodiment according to the invention will be described with reference to the accompanying drawings.

Figure 1:
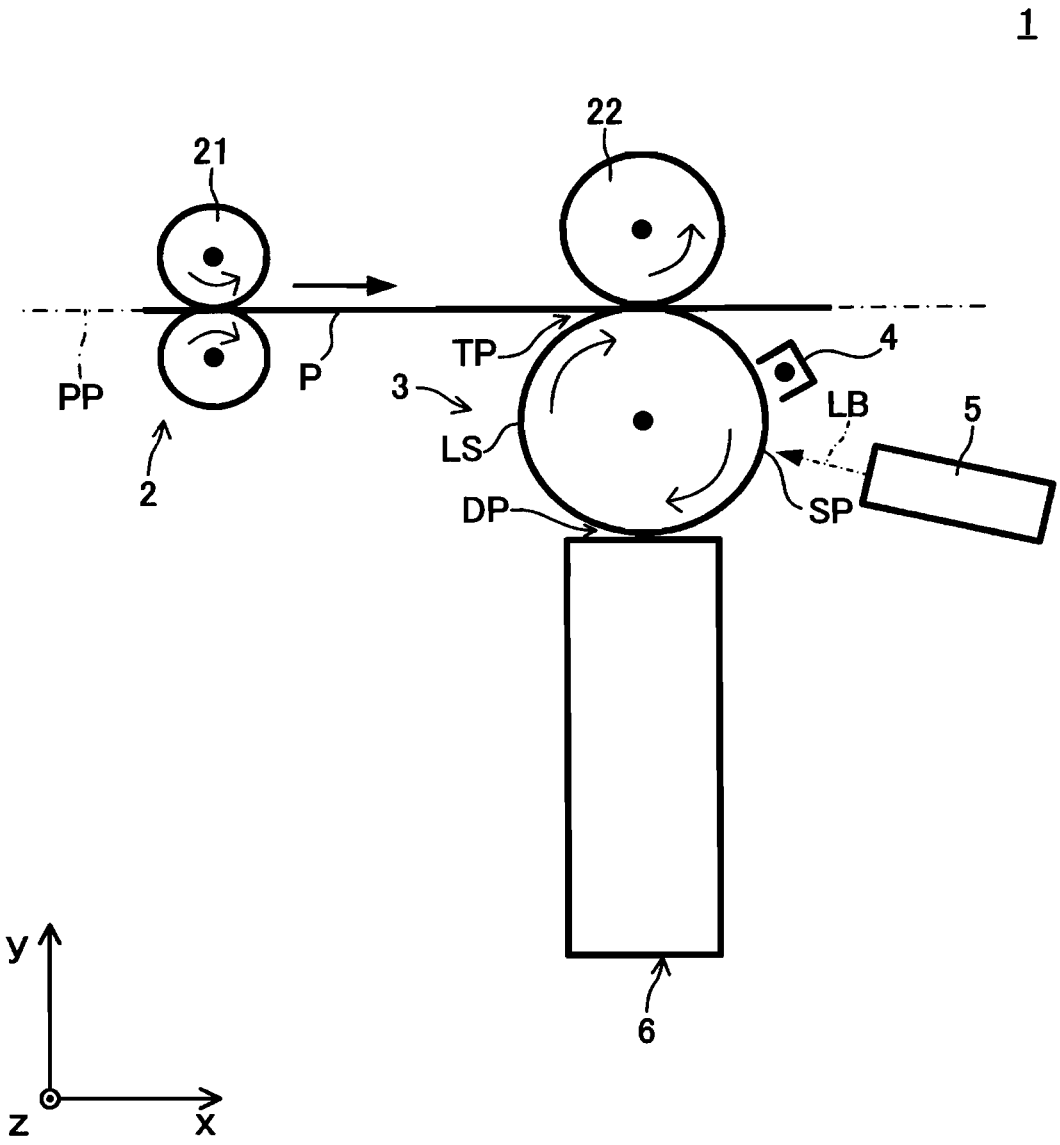
FIG. 1 is a side view illustrating a general configuration of a laser printer according to an embodiment.

As shown in FIG. 1, a laser printer 1 according to the embodiment includes a paper carrying mechanism 2, a photosensitive drum 3, a charger 4, a scanning unit 5 and a toner supply unit 6. On a paper supply tray (not shown) provided in the laser printer 1, a stack of sheets of paper is accommodated. The paper carrying mechanism 2 is configured to carry a sheet of paper P along a paper carrying path PP.

An outer circumferential surface of the photosensitive drum 3 which is a supply target is formed to be an electrostatic latent image holding surface LS. The electrostatic latent image holding surface LS is formed as a cylindrical surface elongated in parallel with a main scanning direction (i.e., a direction of z-axis in FIG. 1). On the electrostatic latent image holding surface LS, an electrostatic latent image is formed as potential distribution, and toner T (developer) is held at portions corresponding to the electrostatic latent image.

The photosensitive drum 3 is configured to rotate in a direction indicated by an arrow in FIG. 1 (i.e., in the clockwise direction) about the center axis extending in the main scanning direction. That is, the photosensitive drum 3 is configured such that the electrostatic latent image holding surface LS moves along an auxiliary scanning direction which is perpendicular to the main scanning direction.

The charger 4 is located to face the electrostatic latent image holding surface LS. The charger 4 is a corotron type charger or a scorotron charger, and is configured to charge uniformly the electrostatic latent image holding surface LS.

The scanning unit 5 is configured to emit a laser beam LB modulated based on image data. That is, the scanning unit 5 emits the laser beam LB which is on/off modulated in accordance with presence/absence of pixel data and which has a predetermined wavelength band. Further, the scanning unit 5 is configured to converge the laser beam LB at a scan position SP on the electrostatic latent image holding surface LS. The scan position SP is located on the downstream side in the rotational direction of the photosensitive drum 3 with respect to the charger 4.

Further, the scanning unit 5 is configured to scan the laser beam LB, at the converged position, on the electrostatic latent image holding surface LS in the main scanning direction at a constant speed, so that an electrostatic latent image is formed on the electrostatic latent image holding surface LS.

The toner supply unit 6 is located under the photosensitive drum 3 to face the photosensitive drum 3. The toner supply unit 6 is configured to supply the toner T, which is in a charged state, to the electrostatic latent image holding surface LS at a development position DP. The development position DP is a position at which the toner supply unit 6 faces the electrostatic latent image holding surface LS. The detailed configuration of the toner supply unit 6 is explained later.

Hereafter, each of the components of the laser printer 1 is explained in detail.

The paper carrying mechanism 2 includes a pair of registration rollers 21 and a transfer roller 22. The registration roller 21 is configured to send the sheet of paper P at predetermined timing toward a position between the transfer roller 22 and the photosensitive drum 3.

The transfer roller 22 is located such that the sheet of paper P is sandwiched at a transfer position TP between the transfer roller 22 and the photosensitive drum 3. Further, the transfer roller 22 is configured to be rotated in the direction indicated by an arrow in FIG. 1 (i.e., in the counterclockwise direction).

The transfer roller 22 is connected to a bias power source (not shown) so that a predetermined transfer voltage for transferring the toner adhered on the electrostatic latent image holding surface LS to the sheet of paper P is applied thereto.

Figure 2:
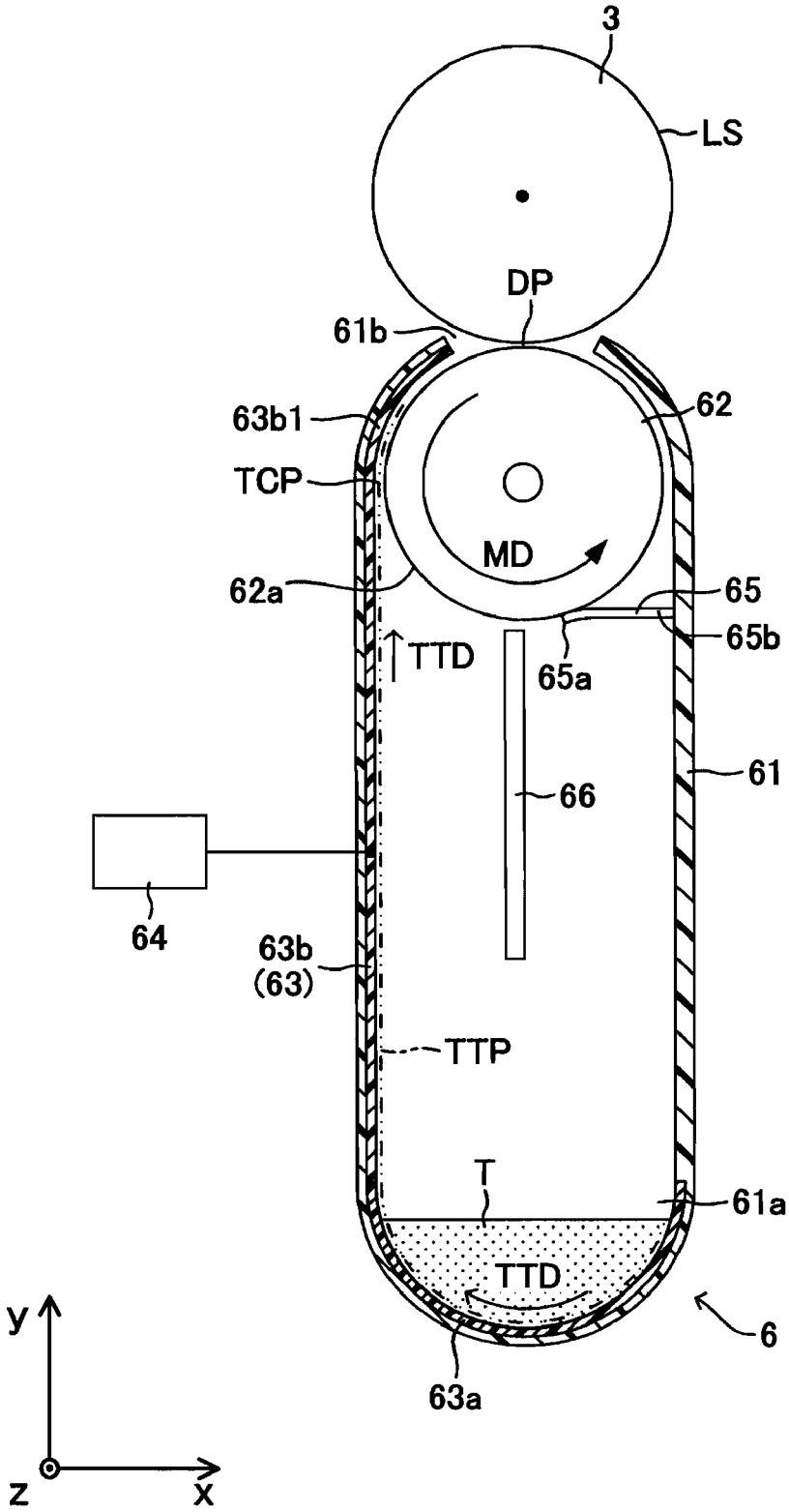
FIG. 2 is an enlarged side cross section illustrating a configuration of a toner supply unit shown in FIG. 1.

As shown in FIG. 2, the toner supply unit 6 is configured to supply the charged toner T to the photosensitive drum 3 by carrying the charged toner T through an electric field along a toner transport path TTP.

A toner box 61 serving as a casing of the toner supply unit 6 is a box type member having an elliptical shape when viewed as a side cross section, and is positioned such that the longer side thereof is in parallel with the vertical direction (i.e., the direction of y-axis). Inside the toner box 61, the toner T which is dry type powdery developer is accommodated. That is, a toner reservoir part 61*a* is formed by semicylindrical inside space formed at the lower end portion of the toner box 61. In this embodiment, the toner T has a positive electrostatic property, and is single component black toner having a nonmagnetic property.

At the top of the toner box 61 (i.e., the position facing the photosensitive drum 3), an opening 61*b* is formed. The opening 61*b* is opened toward the upper side so that the photosensitive drum 3 and the development roller 62 face with each other at the development position DP.

Inside the toner box 61, a development roller 62 serving as a developer holding body is accommodated. The development roller 62 is a roller-like member having a toner holding surface 62*a* which is a cylindrical circumferential surface. The development roller 62 is located to face the photosensitive drum 3 through the opening 61*b*. That is, the toner box 61 and the development roller 62 are located so that, at the development position DP, the toner holding surface 62*a* of the development roller 62 is located closely to the electrostatic latent image holding surface LS of the photosensitive drum 3 via a gap having a predetermined interval (e.g., approximately 500 μm).

Around the top portion of the toner box 61 where the opening 61*b* is formed, the development roller 62 is supported by the toner box 61 to be rotatable about the axis extending in parallel with the main scanning direction. That is, by rotating about the axis in the direction as indicted in FIG. 2 (i.e., in the counterclockwise direction), the toner holding surface 62*a* of the development roller 62 moves in a toner holding surface moving direction MD which is perpendicular to the main scanning direction and thereby the toner T held on the toner holding surface 62*a* is supplied to the development position DP.

Inside the toner box 61, a carrying substrate 63 is provided along the toner transport path TTP. The carrying substrate 63 is fixed on the inner wall of the toner box 61. In this embodiment, the carrying substrate 63 includes a bottom carrying substrate 63*a* and a supply substrate 63*b*. The inner configuration of the carrying substrate 63 is explained in detail later.

The bottom carrying substrate 63*a* is located at the bottom in the inner space of the toner box 61 to form the bottom surface of the toner reservoir part 61*a*. The bottom carrying substrate 63*a* is formed as a recessed curved surface which is curved to have a semicylindrical shape when viewed as a side cross section. Further, the bottom carrying substrate 63*a* is formed to smoothly connect to the lower end of the supply substrate 63*b*. The bottom carrying substrate 63*a* is connected to the lower end of the vertical carrying substrate 63*b* so that the toner T in the toner reservoir part 61*a* is carried to the lower end of the supply substrate 63*b*.

The supply substrate 63*b* is formed to stand to carry the toner T from the toner reservoir part 61*a* to a toner catching position TCP so that the toner T is held on the toner holding surface 62*a* at the toner catching position TCP which is on the upstream side of the development position DP in the toner holding surface moving direction MD (i.e., a moving direction of the toner holding surface 62*a* by rotation of the development roller 62).

More specifically, an upper end portion 63*b*1 of the supply substrate 63*b* (which is an downstream end in the toner transport direction TTD) is formed to be a curved plate formed by dividing a cylindrical plate into 4 to 6 equal portions so that the upper end portion 63*b*1 faces the toner holding surface 62*a* at the position on the upstream side of the development position DP in the toner holding surface moving direction MD via a predetermined gap (e.g., 300 μm). Further, the lower part of the supply substrate 63*b* with respect to the upper end portion 63*b*1 is formed to be a flat plate so that the toner T is carried upward in the vertical direction from the toner reservoir part 61*a* to the toner caching position TCP.

The bottom carrying substrate 63*a* and the supply substrate 63*b* are electrically connected to a bias power circuit 64. The bias power circuit 64 outputs a multiphase alternating voltage (a carrying bias) to carry the toner T along the toner transport path TTP in the toner transport direction TTD.

In this embodiment, the toner supply unit 6 is configured such that the toner transport direction TTD is in an opposite direction of the toner holding surface moving direction MD at the upper end portion 63*b*1 (i.e., at the toner catching position TCP) where the supply substrate 63*b* is closely located with respect to the toner holding surface 62*a*.

Under the toner catching position TCP in the toner box 61, a toner amount limiting blade 65 (serving as a developer amount limiting member) is provided. The toner amount limiting blade 65 is formed such that a front end 65*a* thereof contacts (slides on) the toner holding surface 62*a*. By contacting the toner holding surface 62*a* on an upstream side in the toner holding surface moving direction MD with respect to the development position DP, the toner amount limiting blade 65 uniformises the amount of toner T both in the main scanning direction and in the toner holding surface moving direction MD while limiting the amount of toner T held on the toner holding surface 62 to a predetermined amount.

A proximal end 65*b* which is an opposite end of the front end 65*a* of the toner amount limiting blade 65 is supported by the inner wall of the toner box 61. In this embodiment, the toner amount limiting blade 65 is provided such that the front end 65*a* protrudes from the proximal end 65*b* in an opposite direction of the toner holding surface moving direction MD around the portion where the front end 65*a* contacts the toner holding surface 62*a*. That is, the toner amount limiting blade 65 is provided to contact counter the toner holding surface 62*a*.

More specifically, the toner amount limiting blade 65 is formed such that the toner T scraped off the toner holding surface 62*a* (hereafter, frequently referred to as "redundant toner") falls toward the toner reservoir part 61*a*. Furthermore, the development roller 62, the supply substrate 63*b* and the toner amount limiting blade 65 are arranged such that the upper end portion 63*b*1 is shielded by the development roller 62 from the toner amount limiting blade 65. In other words, the development roller 62 lies between the upper end portion 63*b*1 and the toner amount limiting blade 65.

As described above, the carrying substrate 63 faces the toner holding surface 62*a* at the toner catching position TCP which is a position where the toner T scraped off the toner holding surface 62 does not fall toward the toner reservoir part 61*a*.

Under the center axis of the development roller 62 in the toner box 61, a partition wall 66 is provided. The partition wall 66 is supported by side walls of the toner box 61 in the main scanning direction. The partition wall 66 is located between the carrying substrate 63 (i.e., the supply substrate 63*b*) and the toner amount limiting blade 65. That is, the partition wall 66 prevents the toner T scraped off the toner holding surface 62*a* by the toner amount limiting blade 65 from flying to reach the carrying substrate 63 (i.e., the supply substrate 63*b*).

Figure 3:
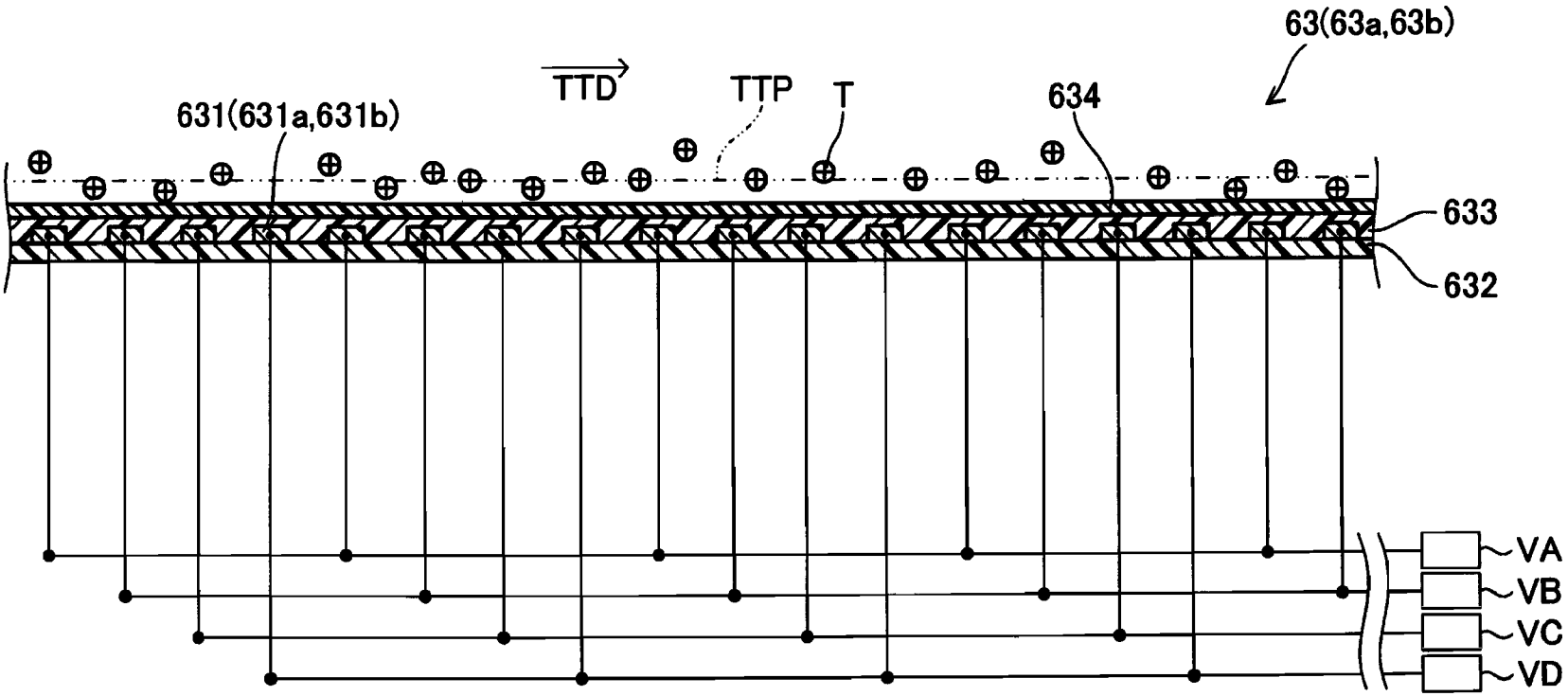
FIG. 3 is an enlarged side cross section of a carrying substrate.

As shown in FIG. 3, the carrying substrate 63 is a thin plate-like member. The carrying substrate 63 has a structure substantially equal to an FPC (Flexible Printed Circuit). More specifically, the carrying substrate 63 includes carrying electrodes 631, an electrode support film 632, an electrode coating 633 and an electrode overcoating 634.

The carrying electrodes 631 are formed as linear patterns, each of which is elongated in parallel with the main scanning direction perpendicular to the auxiliary scanning direction and is formed of copper foil. The plurality of carrying electrodes 631 are aligned in parallel with each other and are arranged in the toner transport path TTP.

Hereafter, the carrying electrodes 631 provided on the bottom carrying substrate 63*a* are frequently referred to as bottom carrying electrodes 631*a*, and the carrying electrodes 631 provided on the supply substrate 63*b* are frequently referred to as supply electrodes 631*a*.

As shown in FIG. 3, the plurality of carrying electrodes 631 aligned along the toner transport path TTP are connected to power supply circuits VA, VB, VC and VD such that the carrying electrodes 631 are connected to the same power supply circuit at every four intervals. That is, the carrying electrode connected to the power supply circuit VA, the carrying electrode connected to the power supply circuit VB, the carrying electrode connected to the power supply circuit VC, the carrying electrode connected to the power supply circuit VD, the carrying electrode connected to the power supply circuit VA, the carrying electrode connected to the power supply circuit VB, the carrying electrode connected to the power supply circuit VC and the carrying electrode connected to the power supply circuit VD . . . are repeatedly arranged in this order along the toner transport path TTP. It should be noted that the power supply circuits VA, VB, VC and VD are provided in each of the carrying power supply circuit 64 and the collecting power supply circuit 65.

Figure 4:
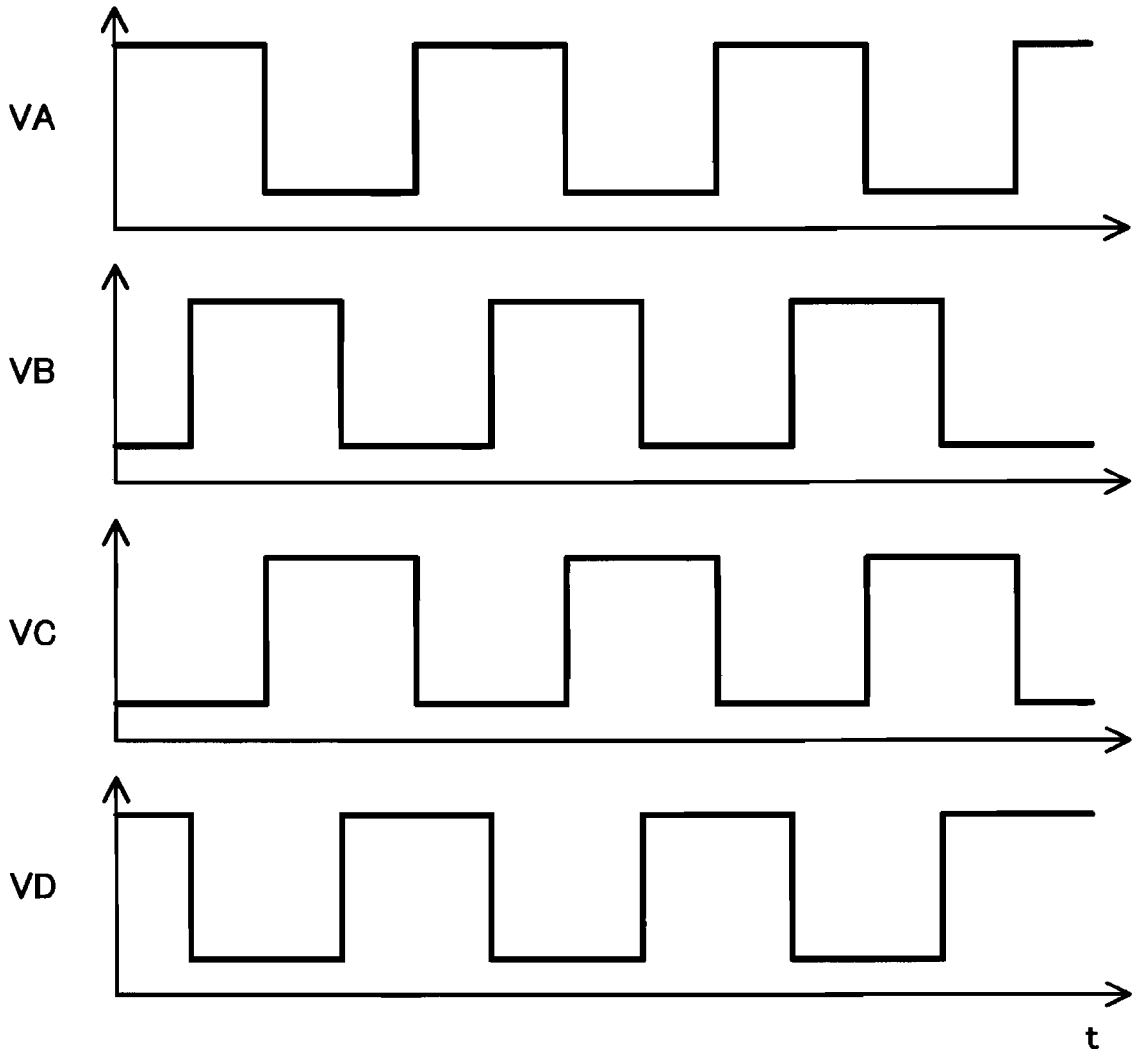
FIG. 4 is a timing chart illustrating waveforms of output signals of power supply circuits.

As shown in FIG. 4, the power supply circuits VA to VD output substantially the same driving voltages (i.e., alternating voltages). The phases of the output voltages of the power supply circuits VA to VD are shift with respect to each other by 90°. That is, in the order of the output signals of the power supply circuits VA to VD, each of the voltage phases of the output signals delays by 90°.

By applying the above described driving voltages to the carrying electrodes 631, the carrying substrate 63 generates a traveling electric field along the toner transport path TTP so that the positively charged toner T is carried in the toner transport direction TTD.

As described above, the carrying substrate 63 is configured to carry the positively charged toner T in the toner transport direction TTP by generating a traveling electric field along the toner transport direction TTP by application of the multiphase alternating voltage to the carrying electrodes 632.

The plurality of carrying electrodes 631 are formed on the electrode support film 632. The electrode support film 632 is an elastic film, for example, made of insulating synthetic resin such as polyimide resin. The electrode coating 633 is made of insulating synthetic resin. The electrode coating 633 is provided to cover the carrying electrodes 631 and a surface of the electrode support film 632 on which the carrying electrodes 631 are formed.

On the electrode coating 633, the electrode overcoating 634 is formed. That is, the electrode coating 633 is formed between the electrode overcoating 634 and the carrying electrodes 631. A surface of the electrode overcoating 634 is formed to be a smooth flat surface without bumps and dips so that the toner T can be carried smoothly.

Hereafter, operations of the laser printer 1 are explained.

As shown in FIG. 1, the leading edge of the sheet of paper P placed on the paper supply tray (not shown) is carried to the registration roller 21. Then, skew of the sheet of paper P is corrected, and the carrying timing is adjusted. Thereafter, the sheet of paper P is carried to the transfer position TP.

While the sheet of paper P is carried to the transfer position TP, an image formed by the toner T is formed on the electrostatic latent image holding surface LS as described below.

The electrostatic latent image holding surface LS of the photosensitive drum 3 is charged by the charger 4 positively and uniformly. The electrostatic latent image holding surface LS charged by the charger 4 moves along the auxiliary scanning direction by rotation in the direction indicated by the arrow in FIG. 1 to reach the scan position SP facing the scanning unit 5.

At the scan position SP, the laser beam LB modulated by image information scans on the electrostatic latent image holding surface LS in the main scanning direction. In accordance with a modulated state of the laser beam LB, the positive charges of the electrostatic latent image holding surface LS are partially removed. As a result, a pattern of the positive charges (corresponding to an image to be formed) appears as an electrostatic latent image.

The electrostatic latent image formed on the electrostatic latent image holding surface LS moves to the development position DP facing the toner supply unit 6 by rotation of the photosensitive drum 3 in the direction indicated y the arrow in FIG. 1 (i.e., in the clockwise direction).

Referring to FIGS. 2 and 3, it is understood that the toner T stored in the toner box 61 charges, for example, by contact and friction with respect to the bottom overcoating 634*a* of the bottom carrying substrate 63*a*. The charged toner T which contacts or is situated closely to the bottom overcoating 634*a* of the bottom carrying substrate 63*a* is carried in the toner transport direction TTD by the electric field generated by application of the carrying bias to the bottom carrying substrates 631*a*, and is passed to the supply substrate 63*b*.

The supply substrate 63*b* carries, upward in the vertical direction, the toner T passed at the lower end portion thereof from the bottom carrying substrate 63*a* to the development roller 62 through the traveling electric field generated by application of the carrying bias to the supply electrodes 631*b*. Then, the toner T is held on the toner holding surface 62*a*, at the toner catching position TCP where the supply substrate 63*b* faces the toner holding surface 62*a*, by the electric field formed between the supply substrate 63*b* and the development roller 62.

It should be noted that toner not properly charged (e.g., toner charged negatively or non-charged toner) has been mixed into the toner T passed from the bottom carrying substrate 63*a*. However, due to gravity or an electric field generated between the vertical carrying substrate 63*b* and the development roller 62, the toner not properly charged falls downward when the toner T is carried upward in the vertical direction along the vertical carrying substrate 63*b* or when the toner T is attracted toward the development roller 62 by the electric field acting between the vertical carrying substrate 63*b* and the development roller 62.

With this configuration, on the supply substrate 63*b*, the toner not properly charged is separated from the toner T suitably charged. The toner which has fallen downward from the supply substrate 63*b* is circulated to the toner reservoir part 61*a*. Then, the toner T is carried upward again by the supply substrate 63*b*.

As described above, the toner holding surface 62*a* to which the toner T moves at the toner catching position TCP moves in the toner holding surface moving direction MD by rotation of the development roller 62, and then contacts counter the front end 65*a* of the toner amount limiting blade 65. With this configuration, the toner amount held on the toner holding surface 62*a* is suitably uniformised.

The redundant toner scraped off the toner holding surface 62*a* by the front end 65*a* of the toner amount limiting blade 65 falls toward the toner reservoir part 61*a*. At this time, the redundant toner does not reach the toner catching position TCP. Therefore, according to the embodiment, it is securely prevented that the redundant toner interferes movement of the toner T to the toner holding surface 62*a* at the toner catching position TCP in contrast to the configuration of the conventional toner supply device disclosed for example in Japanese Patent Provisional Publications No. 2002-287495A and NO. 2006-47654A.

In this embodiment, the toner amount limiting blade 65 contacts counter the toner holding surface 62*a*, and the partition wall 66 is provided on the protruded side of the toner amount limiting blade 65. Therefore, the redundant toner scraped off the toner holding surface 62*a* by the front end 65*a* of the toner amount limiting blade 65 falls toward the toner reservoir part 61*a* while being guided by the partition wall 66 so that the redundant toner does not fly to the flat plate portion of the supply substrate 63*b*. With this configuration, it becomes possible to prevent the redundant toner from flying to the supply substrate 63*b* and accumulating on the supply substrate 63*b*, and thereby it becomes possible to prevent the redundant toner from interfering the carrying of the toner T in the toner transport direction TTP to the toner catching position TCP.

Furthermore, according to the embodiment, the rotational direction of the development roller 62 is set such that, at the toner catching position TCP, the toner holding surface 62*a* moves in the direction which is opposite to the toner transport direction TTD. As a result, it becomes possible to let the toner holding surface 62*a* face the photosensitive drum 3 through the opening 61*b* in the state where the amount of toner T is suitably uniformised by the toner amount limiting blade 65, with a simple structure.

In accordance with rotation of the development roller 62, the toner holding surface 62*a* moves in the toner holding surface moving direction MD from the position where the toner holding surface 62*a* contacts the toner amount limiting blade 65, and reaches the development position DP. As a result, the toner T is supplied to the development position DP. At the development position DP, the electrostatic latent image formed on the electrostatic latent image holding surface LS is developed by the toner T. That is, to the portions where positive charges are removed from the electrostatic latent image holding surface LS, the toner T adheres. Consequently, the image formed by the toner T (hereafter, frequently referred to as a toner image) is held on the electrostatic latent image holding surface LS.

As shown in FIG. 1, the toner image held on the electrostatic latent image holding surface LS of the photosensitive drum 3 is carried to the transfer position TP by rotation of the electrostatic latent image holding surface LS in the direction shown by the arrow in FIG. 1. Then, at the transfer position TP, the toner image is transferred from the electrostatic latent image holding surface LS to the sheet of paper P.

As shown in FIG. 2, the toner amount limiting blade 65 may be formed of an elastic member so as to elastically contact the toner holding surface 62*a* of the development roller 62. The position of the toner amount limiting blade 65 may be defined such that the toner amount limiting blade 65 is located at a position shifted by 90° or more, on the developer holding surface 62*a*, in a rotational angle of the development roller 62, with respect to the toner catching position TCP.

Although the present invention has been described in considerable detail with reference to certain preferred embodiments thereof, other embodiments are possible.

(1) Application of the above described embodiment is not limited to a monochrome laser printer. For example, the above described embodiment may be applied to various types of electrophotographic printers, such as a color laser printer and a monochrome or color copying device. In such a case, the shape of a photosensitive body is not limited to the drum shape described in the embodiment. For example, a flat plate type or endless belt type photosensitive body may be employed.

Various types of light sources for exposing other than the laser scanning unit may be employed. For example, LED, EL (electroluminescence) device or a fluorescent element may be employed.

The above described embodiment may also be applied to an image forming device which is not the electrophotographic type image forming device. For example, the above described embodiment may be applied to a toner jet type device, an ion flow type device and a multi-stylus type device which do not use a photosensitive body.

(2) The configuration of the carrying substrate 63 is not limited to that shown in the above described embodiment. For example, the electrode overcoating 634 may be omitted. Alternatively, by burying the carrying electrodes 631 in the electrode support film 632, the electrode coating 633 and the electrode overcoating 634 can be omitted.

The central part of the bottom carrying substrate 63*a* may be formed to have a flat shape. That is, only the connection part of the bottom carrying substrate 63*a* with respect to the supply substrate 63*b* may be formed as the curved plate part. Furthermore, the bottom carrying substrate 63*a* may be formed integrally with the supply substrate 63*b* or may be formed as a separate part separated from the supply substrate 63*b*.

(3) It is preferable that the upper end of the partition wall 66 is positioned closely to the lower end of the development roller 62 to the extent that the upper end of the partition wall 66 does not contact the toner holding surface 62*a* which moves in accordance with rotation of the development roller 62 (i.e., to the extent that the condition of the toner T held on the toner holding surface 62*a* is not disturbed before the toner amount is limited by the toner amount limiting blade 65). With this configuration, it becomes possible to prevent the redundant toner from flaying to the supply substrate 63*b* or from accumulating on the supply substrate 63*b*, and thereby it becomes possible to prevent the redundant toner from interfering the carrying of the toner T in the toner transport direction TTD to the toner catching position on the supply substrate 63*b*.

Figure 5:
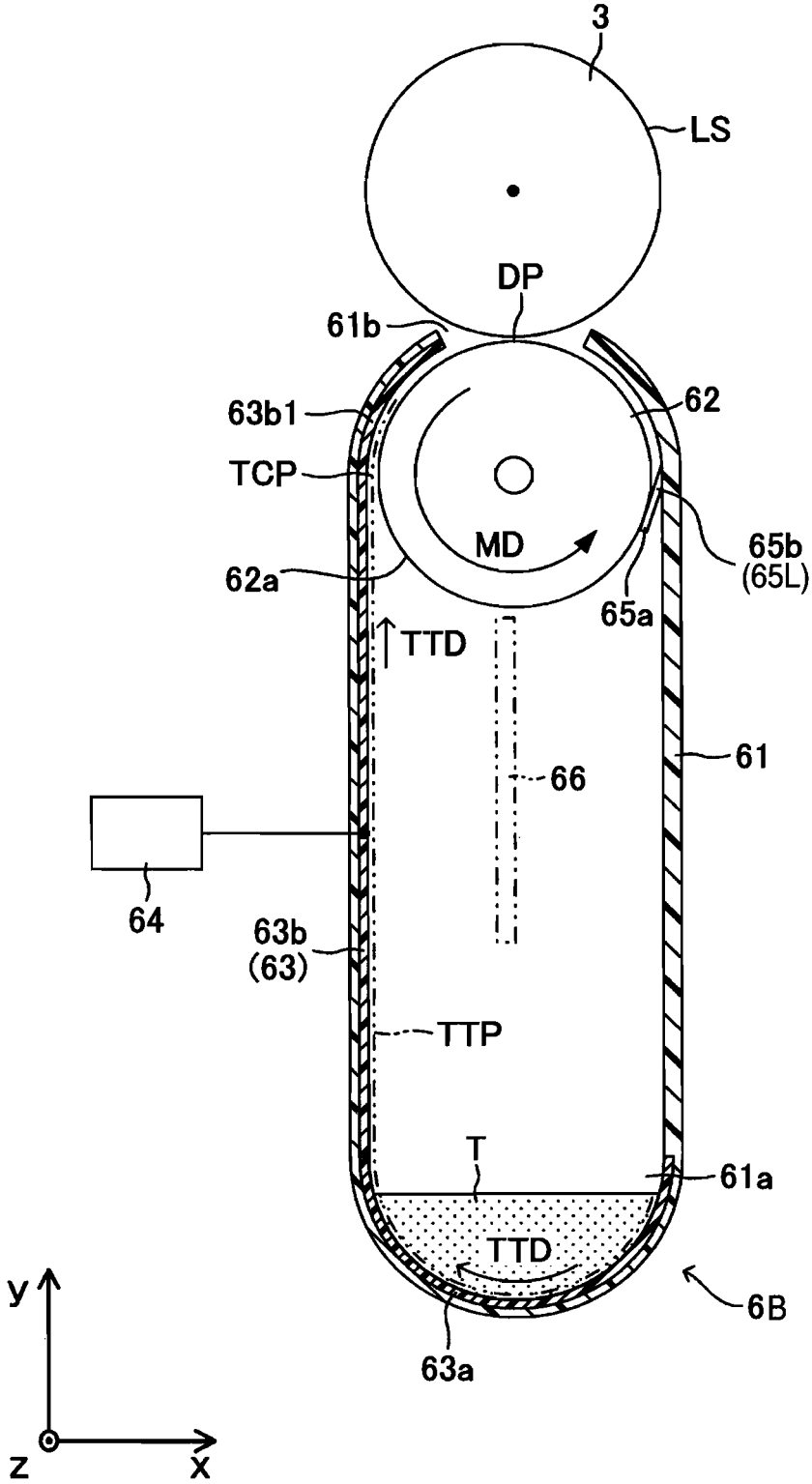
FIG. 5 is an enlarged side cross section illustrating a configuration of a first variation of the toner supply unit.

Hereafter, a first variation of the toner supply unit (a toner supply unit 6B) is explained with reference to FIG. 5. It should be noted that, in FIG. 5, to elements which are substantially the same as those of the above described embodiment, the same reference numbers are assigned and explanations thereof will not be repeated. As shown in FIG. 5, a toner amount limiting blade 65L may be provided in the toner supply unit 6B such that the front end 65*a* protrudes downward from the proximal end 65*b*. Preferably, the front end 65*a* is oriented toward the toner reservoir part 61*a*. In this case, the partition wall 66 may be omitted (as indicated by an imaginary line (66) in FIG. 5).

(4) The waveforms of the output voltages of the power supply circuits VA to VD are not limited to the rectangular shape shown in FIG. 4. For example, sine waveforms or triangular waveforms may be employed as output voltages of the power supply circuits VA to VD. In the above described embodiment, four power supply circuits VA to VD are provided, and phases of the output voltages of the power supply circuits VA to VD are shift by 90° with respect to each other. However, the embodiment is not limited to such a structure. For example, in another embodiment, three power supply circuits may be employed, and in this case phases of output voltages of the three power supply circuits may shift by 120° with respect to each other.

Figure 6:
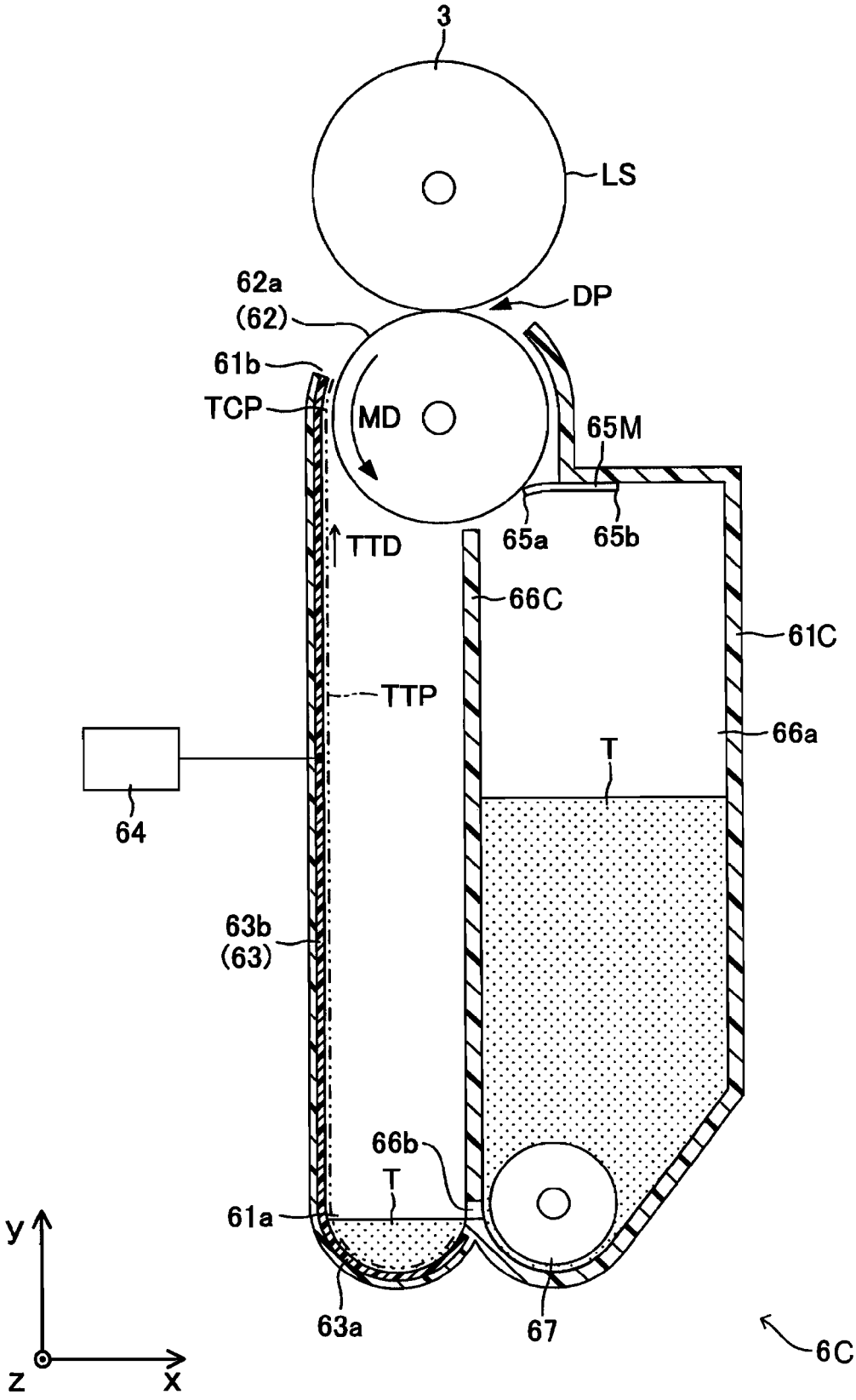
FIG. 6 is an enlarged side cross section illustrating a configuration of a second variation of the toner supply unit.

Hereafter, a second variation of the toner supply unit (a toner supply unit 6C) is explained with reference to FIG. 6. It should be noted that, in FIG. 6, to elements which are substantially the same as those of the above described embodiment, the same reference numbers are assigned and explanations thereof will not be repeated. As shown in FIG. 6, in the toner supply unit 6C, a partition wall 66C is provided such that the lower end thereof reaches the bottom wall of a toner box 61C.

As shown in FIG. 6, the inner space of the toner supply unit 6C is divided by the partition wall 66C into two portions including the toner reservoir part 61*b* adjacent to the supply substrate 63*b* (i.e., a portion where the carrying substrate 63 is provided) and a toner reservoir part 66*a* which is apart from the supply substrate 63*b* (i.e., a portion where the carrying substrate 63 is not provided). The toner amount limiting blade 65M is located above the toner reservoir part 66*a* so that the redundant toner scraped off the toner holding surface 62*a* falls into the toner reservoir part 66*a*.

Furthermore, a communication hole 66*b* is formed in the bottom portion of the partition wall 66. The communication hole 66*b* is formed such that the top part of the toner reservoir part 61*a* and the toner reservoir part 66*a* communicate with each other. At the bottom of the toner reservoir part 66*a*, an agitator 67 is provided to send the toner to the top part of the toner reservoir part 61*a* by rotation of the agitator 67.

With this configuration, by rotating the agitator 67, it becomes possible to keep the level of the toner T in the toner reservoir part 61*a* constant. In this case, it is necessary to drive the agitator 67 each timer a predetermined amount of printing is performed or to drive the agitator 67 at predetermined timing, or to provide a toner level sensor to detect the level of the toner T at the toner reservoir part 61*a*.

What is claimed is:

1. A developer supply device, comprising:

a developer holding body having a cylindrical developer holding surface and a rotation axis extending in a main scanning direction so that, by rotating about the rotation axis, the developer holding surface moves in a direction perpendicular to the main scanning direction and a developer held on the developer holding surface is carried to a developer supply position where the developer holding surface faces a supply target;

a developer amount limiting member that limits an amount of the developer held on the developer holding surface by contacting the developer holding surface on an upstream side in a moving direction of the developer holding surface with respect to the developer supply position; and a carrying substrate that carries the developer from a developer reservoir to the developer holding body through a traveling electric field, wherein the carrying substrate faces the developer holding surface at a developer holding position where the developer is held on the developer holding surface, the developer amount limiting member being located at a position lower than the developer holding position, and wherein a position to which the developer scraped off the developer holding surface by the developer amount limiting member falls is different from the developer holding position.

2. The developer supply device according to claim 1, wherein the developer amount limiting member is arranged such that the developer scraped off the developer holding surface by the developer amount limiting member falls in the developer reservoir.

3. The developer supply device according to claim 1, wherein at the developer holding position, the moving direction of the developer holding surface is opposite to a carrying direction of the developer by the carrying substrate.

4. The developer supply device according to claim 1, further comprising a casing having a box shape and having the toner reservoir formed as inner space at a bottom portion of the casing, wherein:

the carrying substrate is supported on an inner wall of the casing; and the developer holding body is located inside of the casing.

5. The developer supply device according to claim 1, wherein:

the carrying substrate carries the developer upward from the developer reservoir to the developer holding position; and the developer holding body is located between an upper end part of the carrying substrate facing the developer holding body and the developer amount limiting member.

6. The developer supply device according to claim 1, further comprising a partition wall located between the carrying substrate and the developer amount limiting member.

* * * * *